United States Patent [19]

Epes

[11] 4,081,120

[45] Mar. 28, 1978

[54] BUILDING PRESS

[76] Inventor: Archie C. Epes, 1705 Audubon Pl., Shreveport, La. 71105

[21] Appl. No.: 687,022

[22] Filed: May 17, 1976

[51] Int. Cl.[2] ..... B27F 7/02

[52] U.S. Cl. ..... 227/113; 227/152; 100/269 A; 100/DIG. 13

[58] Field of Search ..... 227/30, 113, 152; 100/269 A, DIG. 13

[56] References Cited

U.S. PATENT DOCUMENTS

| | | | |
|---|---|---|---|
| 1,127,838 | 2/1915 | Willers | 227/147 |
| 1,312,615 | 8/1919 | Cooper | 100/269 A |
| 2,540,106 | 2/1951 | Eichelberger | 227/152 |
| 2,560,902 | 7/1951 | Smith | 100/269 A |
| 3,190,215 | 6/1965 | Howard et al. | 100/269 A |
| 3,390,628 | 7/1968 | Sanford | 227/152 |
| 3,765,322 | 10/1973 | Weyer | 100/269 A |
| 3,808,968 | 5/1974 | Notin | 100/269 A |
| 3,939,764 | 2/1976 | McCormack | 227/152 |

*Primary Examiner*—Granville Y. Custer, Jr.

[57] ABSTRACT

A building press for joining building components which includes a frame having a fixed portion and at least one movable hammer, which frame is designed to receive a predetermined number of building components and to join the components with selected fasteners by means of fluid pressure such as air. The frame is equipped with at least one expandable conduit or several air, steam or hydraulic cylinders positioned between a fixed member of the frame and the hammer or hammers, and in a preferred embodiment, a multiplicity of fasteners are magnetically positioned on segments of the hammer to be driven into the building components. When a fluid such as air, oil or water is forced through the conduit the conduit expands and the hammer or hammers force the nail plates into the building components to securely join the components in a selected configuration. In the alternative, the components may be joined by applying hydraulic pressure on several hydraulic cylinders by means of air, steam, oil or other suitable fluid.

7 Claims, 11 Drawing Figures

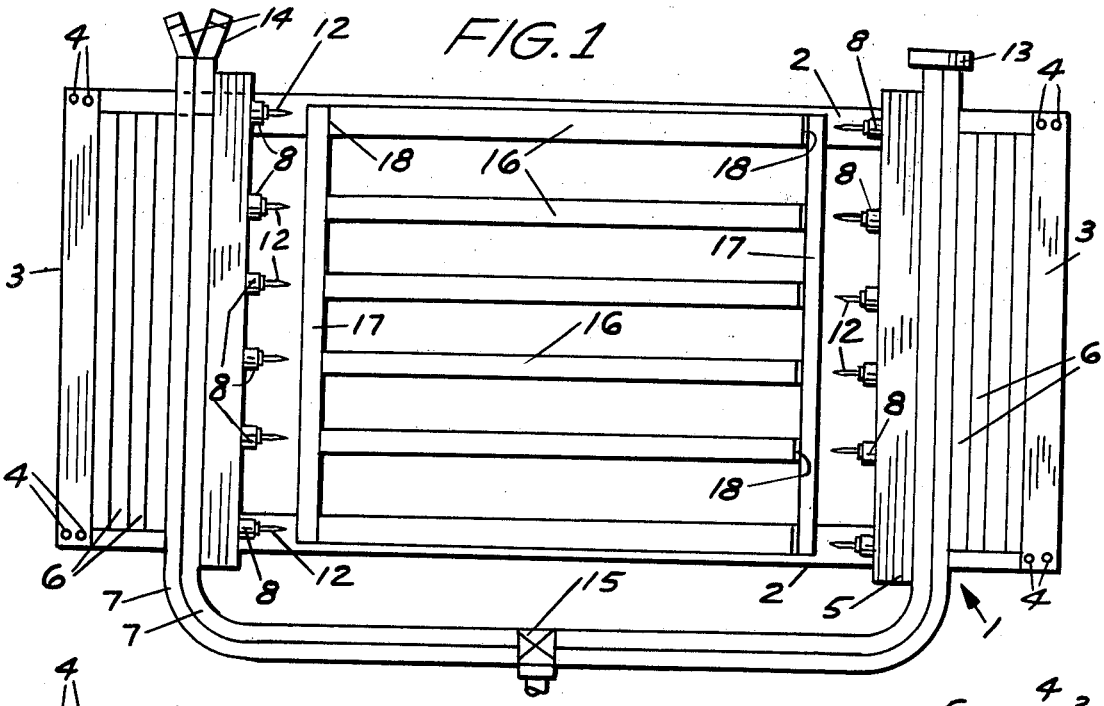
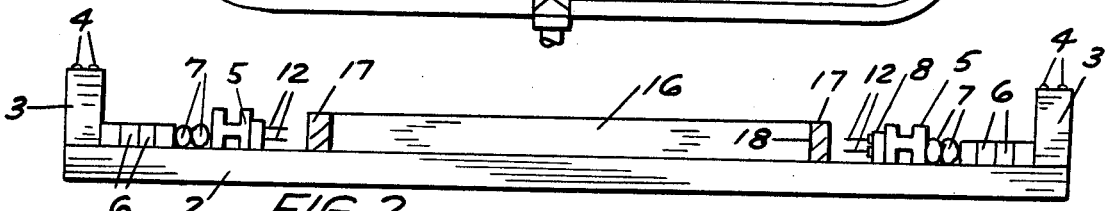
FIG. 2
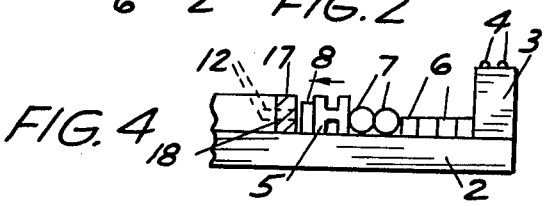
FIG. 4
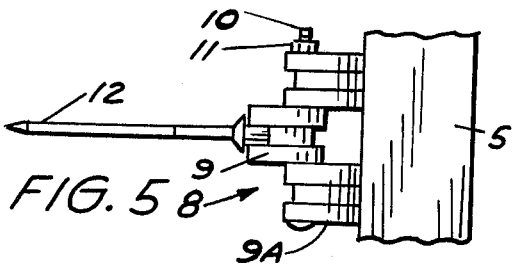
FIG. 5
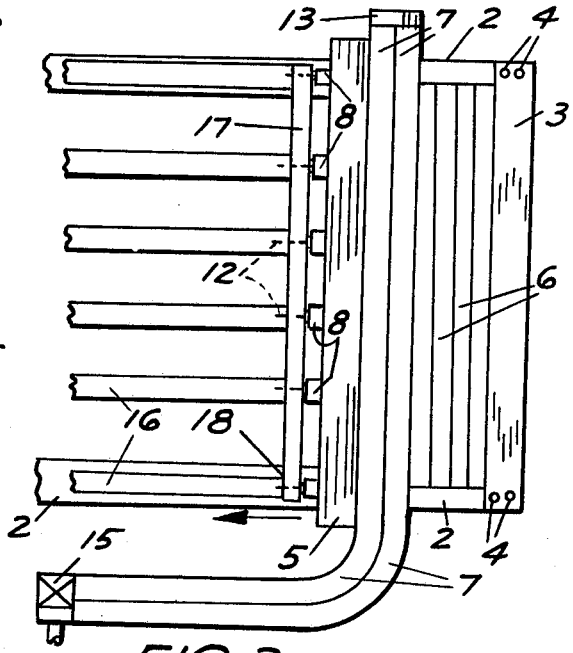
FIG. 3
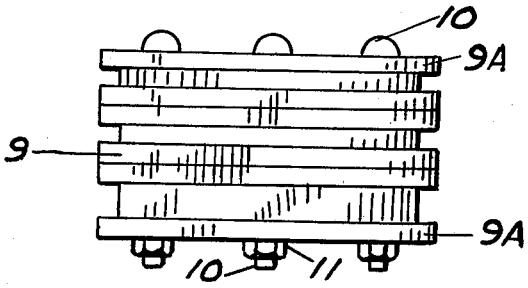
FIG. 6

BUILDING PRESS

BACKGROUND OF THE INVENTION

1. Field of the Invention

This invention relates to a new and improved building press or jig whereby multiple building components, including truss members, can be joined simultaneously by application of fluid pressure such as air, through several hydraulic cylinders or through an expandable hose. The building press consists of a fixed frame having at least one movable hammer, between which frame and hammer is placed a fluid conduit or hose, or several air, steam or hydraulic cylinders. Nails, nail plates or other suitable fasteners can then be positioned in selected locations on the hammer or hammers, the hose pressured with fluid (preferably water) or the hydraulic cylinders activated, and the fasteners thereby driven into the building components at selected locations. For example, an entire wall section of selected length, or the interior or exterior wall section for a completed building, as well as truss members for a roof section may be assembled in the frame or jig and fastened together simultaneously and automatically, if desired, by the turn of a lever by application of fluid pressure and utilization of the building press of this invention. Roof trusses may also be manufactured singularly, or several trusses built simultaneously with only one squeeze of the press.

2. Description of the Prior Art

Heretofore, the primary method of joining building components has been by nailing, with each joint nailed separately by hand. This procedure has been modified to some extent in recent years by placing the component parts in a jig or tight frame and nailing the parts together with hammer and nail or with pneumatic guns. Some housing components such as roof trusses are manufactured by pressing flat steel plates with attached protrusions such as nails into the wood where the material is to be joined. This has been accomplished by truss rollers and pneumatic guns positioned to each joint and the steel plate squeezed into the wood one at a time or simultaneously with a group of pneumatic guns, each positioned at a specific joint. In the latter case where "gang" nails are used, the nailing must still be accomplished for the most part by hand, or with hand operated pneumatic guns, or in the alternative, by complicated equipment designed to place considerable pressure at specifically designated points on the component parts of the truss or other member to achieve a tight fit. Pneumatic guns are constantly breaking down or running out of fasteners, which slows the production and truss rollers are slow and waive quality control. Accordingly, such techniques are characterized by high expense and expenditure of a large amount of time, whether the structure being built is assembled piecemeal by a carpenter or by use of "gang" nail procedures. In the former case, the carpenter must nail each joint individually, by hand, and each piece must be cut separately to fit, thereby resulting in a large expenditure of time and money with no real assurance that the component parts will be fitted to a high tolerance.

Accordingly, an object of this invention is to provide an improved mechanism for constructing wall and truss sections and other construction component assemblies where multiple joints must be joined together.

Another object of this invention is to provide a building press for joining construction components for houses, buildings and other structures, which is simple in design, inexpensive to set up, and may be specifically designed for joining substantially all component parts in a desired fabrication.

A still further object of the invention is to provide a new and improved building press or jig whereby the component parts of a structure such as a truss section may be fabricated by means of water, air or other fluid pressure applied through a conduit or hose or several air, steam or hydraulic cylinders in the jig.

Yet another object of the invention is to provide a new and improved apparatus for constructing the component parts of a structure which includes the use of a frame having a fixed and movable portion and applying fluid pressure through a hose or several air, steam or hydraulic cylinders located between the fixed and movable portions of the frame to drive nails or other fasteners into the component parts in the fabricating process.

SUMMARY OF THE INVENTION

These and other objects of the invention are provided in a building press for assembling component parts of a structure which includes the following elements:

1. A frame or jig having a fixed portion and at least one movable portion or hammer;

2. At least one fluid conduit or several air or hydraulic cylinders located between the fixed portion of the frame and the hammer or hammers and adapted to receive a pressurized fluid at selected time intervals; and

3. Means for positioning and carrying nails or other suitable fasteners in cooperation with the hammer or hammers whereby when air, oil, water or other fluid pressure is applied to the conduit or through operation of an air or hydraulic cylinder, the hammer or hammers exert pressure on the nails or alternative fasteners, and simultaneously forces them into the component building parts to be joined.

BRIEF DESCRIPTION OF THE DRAWINGS

The invention will be better understood in view of the following description presented with reference to the accompanying drawings.

FIG. 1 of the drawings is a top view of a typical building press of this invention illustrating the press in driving configuration with fasteners in position and ready for fluid activation;

FIG. 2 is a front elevation of the building press illustrated in FIG. 1;

FIG. 3 is a top view, partially in section, of the building press illustrated in FIG. 1, in closed configuration after the fasteners have been driven into the building components;

FIG. 4 is a front elevation, partially in section, of the building press illustrated in FIG. 3;

FIG. 5 is a side elevation of a preferred nail positioner of the building press illustrated in FIGS. 1–4 of the drawing;

FIG. 6 is a front elevation of the nail positioner of the building press illustrated in FIGS. 1–5 of the drawing;

DESCRIPTION OF THE PREFERRED EMBODIMENTS

Figure 7:
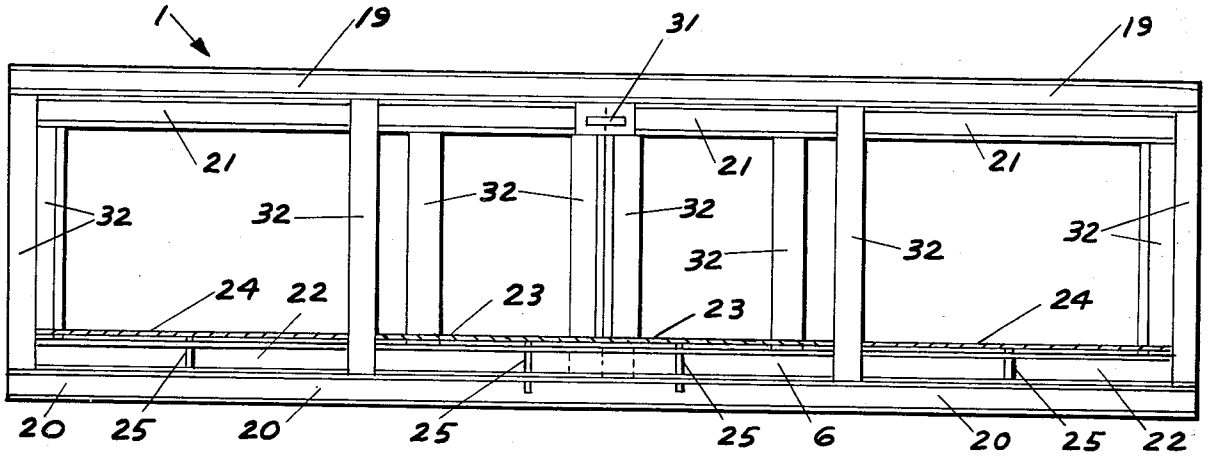
FIG. 7 of the drawings is a front elevation of an alternative embodiment of the building press of this invention illustrating the building press in configuration suitable for multiple truss construction, or construction of components where "gang nail" plates are used, and illustrated in position ready for loading of truss members.

Referring now to FIG. 1 of the drawing, the building press of this invention, generally illustrated by reference numeral 1, is shown in open configuration, with frame 2, carrying frame stop 3 by means of frame stop bolts 4, and hammer 5, spaced from frame stop 3 by at least one optional filler 6 and hoses 7. Nail positioners 8, (more particularly illustrated in FIGS. 5 and 6) are fitted with forward magnets 9 and rear magnets 9A, which are in turn joined by nail positioner bolts 10 and nail positioner nuts 11. Nails 12 are illustrated in position on magnets 9 to join horizontal building components 16 and vertical building components 17 at building component joints 18. Referring now to FIG. 2 of the drawing, hoses 7 are shown in collapsed configuration between hammer 5 and fillers 6. It will be understood that hoses 7 may be replaced with several air, steam or hydraulic cylinders attached to filler 6, as desired, to serve the same function as hoses 7. Nails 12 are also spaced from vertical building components 17 to allow both vertical building components 17 and horizontal building components 16 to be appropriately placed in frame 2 and to permit proper positioning of nail positioners 8 on hammer 5 prior to the fastening operation. Fillers 6 are designed to compensate for variance in the size of horizontal building components 16 and vertical building components 17.

Referring now to FIGS. 3 and 4 of the drawing, it will be appreciated that when hose clamps 13 are sealed and fluid release valves 14, shown in FIG. 1, are closed, and when air, water, oil, or other suitable fluid is allowed to enter hoses 7 by operation of fluid inlet valve 15, hoses 7 will expand as illustrated, and force hammer 5 to move in the direction of the arrow. This movement of hammer 5 causes nails 12 to be forced into building component joints 18, thereby joining horizontal building components 16 and vertical building components 17 at building component joints 18. Release valves 14 can then be activated, the fluid drained from hoses 7, hammer 5 retracted manually or mechanically as the pressure is released from hoses 7, and the completed building section removed from the frame. Additional components can then be placed in the frame, more nails or alternative fastening means placed on magnets 9, and the procedure outlined above repeated. The same process takes place when hoses 7 are substituted with several air, steam or hydraulic cylinders which move hammer 5 in the same manner.

Referring now to FIG. 5 of the drawing it will be appreciated that nail positioner 8 is composed of forward magnets 9, rear magnets 9A, nail positioner bolt 10, and nail positioner nut 11. Forward magnets 9 serve to hold nails 12 onto nail positioner 8, and rear magnets 9A hold nail positioner 8 onto hammer 5. As hereinafter noted, forward magnets 9 and rear magnets 9A are joined by nail positioner bolt 10 and nail positioner nut 11. Accordingly, nail positioner 8 can be placed at substantially any position along hammer 5 by simply removing the nail positioner and magnetically securing it at the desired location to accommodate construction of a structure having a desired configuration.

It will be further appreciated that in addition to nails, other suitable fasteners such as screws, rivets, staples and the like may be utilized in the invention to join the building components as desired. Multiple joints can be joined, limited only by the size of the particular section being fabricated, and several presses may be arranged for simultaneous operation to provide capability for assembling the component parts for an entire house, mobile home, crate, box or the like, as desired. By use of a magnetic fastener positioner such as nail positioner 8 the press configuration can be changed in a matter of seconds from wall sections, for example, with studs on 16" centers, to sections having studs on 24" centers, or to change the location of rough openings for doors, windows and the like, as desired.

In another embodiment of the invention, bands of nails, staples, screws, bolts, rivets or other fasteners, spaced as desired and fastened at the head to a wire, plastic band or other continuous band may be utilized to provide automatic fastener feeding of the building press of this invention.

Figure 8:
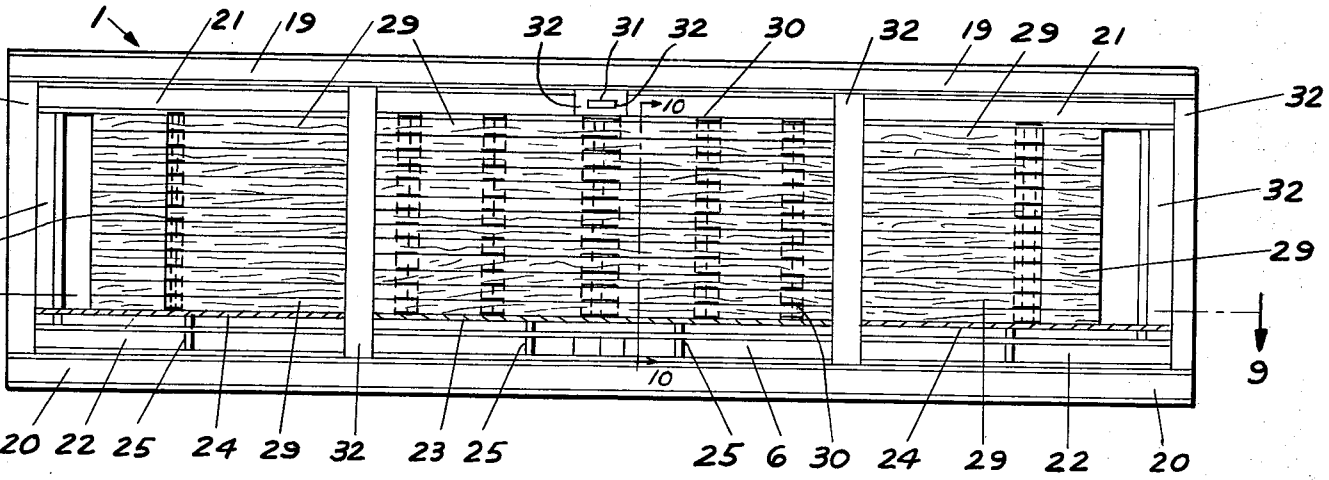
FIG. 8 is a front elevation of the building press illustrated in FIG. 7 with several truss members loaded and constructed by application of fluid pressure.

Referring now to FIGS. 7 and 8 of the drawing, an alternative configuration of building press 1 is illustrated for assembling roof truss members, and any component where "gang nail" steel plates are used. FIG. 7 shows building press 1 in unloaded configuration while FIG. 8 illustrates the press in loaded condition. Upper bottom cord frame member 19 and lower bottom cord frame member 20 form the lower cord frame members, while upper top cord frame members 21 and lower top cord frame members 22 form the opposite or top cord frame members of building press 1. Upper bottom cord frame member 19 is spaced from lower bottom cord frame member 20 by spacers 32.

Figure 9:
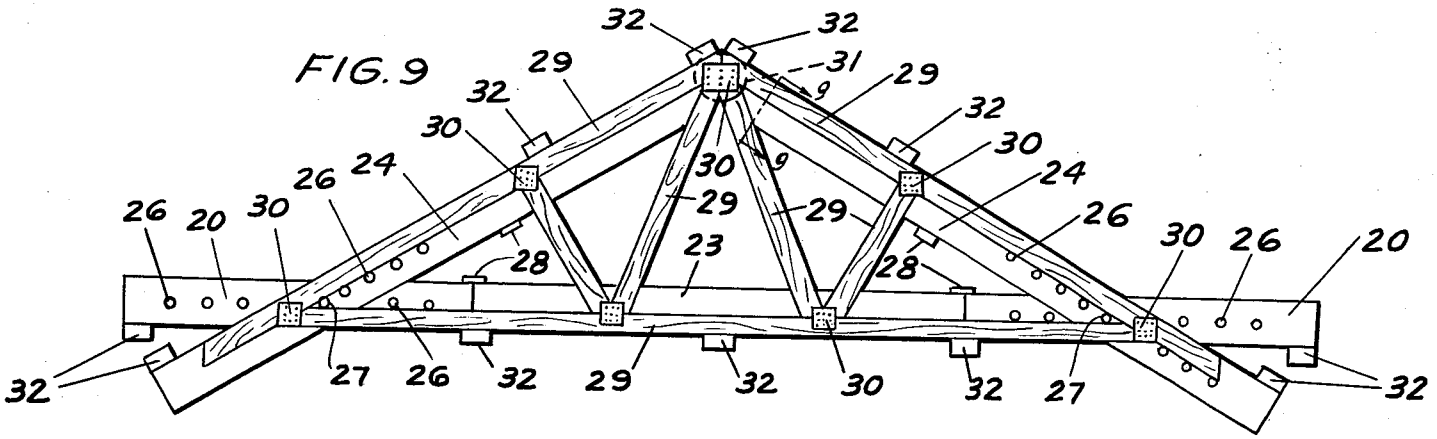
FIG. 9 is a top view, partially in section, of the building press illustrated in FIG. 8, with the section taken along lines 9—9, and shown with a single truss member therein constructed by application of fluid pressure.

Referring now to FIGS. 7–9 of the drawing, it will be appreciated that pressure is brought to bear on truss members 29 placed in building press 1 by means of bottom cord hammer 23 and top cord hammers 24. Bottom cord hammer 23 is movably mounted by means of hammer guides 25 in a filler 6 and lower bottom cord frame member 20, while top cord hammers 24 are movably mounted by means of hammer guides 25 in lower top cord frame members 22. Upper bottom cord frame member 19, lower bottom cord frame member 20, upper top cord frame members 21 and lower top cord frame members 22 are preferably I beams. A filler 6 is positioned between lower bottom cord frame member 20 and bottom cord hammer 23 in order to position bottom cord hammer 23 level with top cord hammer 24. In like manner, a second filler 6 is located between upper bottom cord frame member 19 and the top one of truss members 29 placed in building press 1 to provide a level top surface for pressuring truss members 29. Hoses 7 are positioned between bottom cord hammer 23 and the filler 6 positioned between lower bottom cord frame member 20 and bottom cord hammer 23, and between top cord hammers 24 and lower top cord frame members 22, respectfully.

Figure 10:
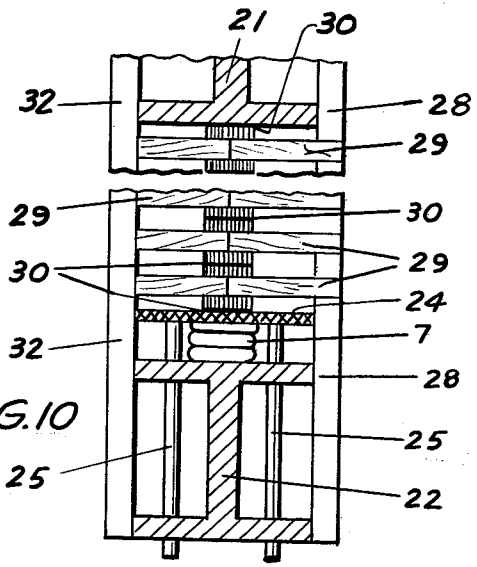
FIG. 10 is a sectional view taken along lines 10—10 of the building press illustrated in FIG. 8, and more particularly showing the hammer, truss and fastener configurations prior to pressuring of the fluid conduit.

Referring now to FIGS. 7, 9 and 10, and particularly to FIG. 10 of the drawings, truss members 29 are stacked inside building press 1 with nail plates 30 located as illustrated at each joint to be joined. Nail plates 30 each consist of a metal plate having a plurality of nails attached by the head thereof to the metal plate to enable joining of truss members 29 in the manner illustrated. After truss members 29 and nail plates 30 are positioned in stacked relationship in building press 1, truss members 29 are securely blocked into place in building press 1 by means of removable braces 28.

Figure 11:
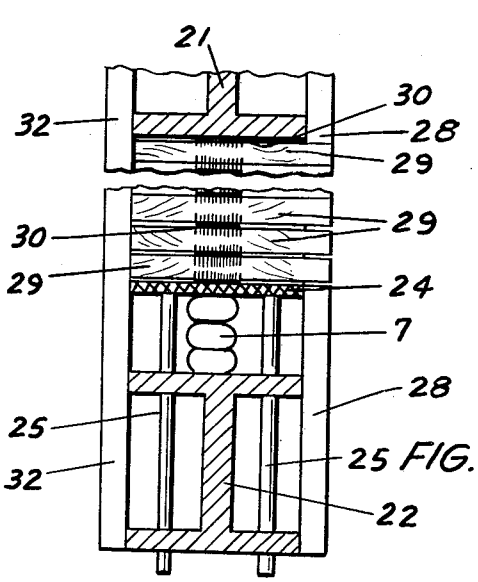
FIG. 11 is a sectional view also taken along lines 10—10 of the building press illustrated in FIG. 8 showing the hammer, truss and fastener configuration after pressuring of the fluid conduit.

Referring now to FIGS. 8 and 11 of the drawing, after truss members 29 are carefully stacked into place on nail plates 30 and blocked into position by means of removable braces 28, hose 7 is pressurized by a suitable fluid such as air or water, but preferably water, and nail plates 30 are pressed into truss members 29 by the expansion of hose 7 and corresponding upward movement of bottom cord hammer 23 and top cord hammers 24, respectively, as illustrated. The fabricated truss members 29 can then be removed from building press 1 after removable braces 28 are removed, and new truss members 29 can then be placed in building press 1 for fabrication, as described above. Hose 7 may be replaced with several air, steam or hydraulic cylinders attached to lower top cord frame members 22, as heretofore noted.

It will be appreciated by reference to FIGS. 7 and 9 of the drawing that building press 1 is adjustable to provide a fabricated truss member of varying pitch and to permit removal of the completed trusses from building press 1. Adjusting holes 26 in lower bottom cord frame member 20 and lower top cord frame members 22 permit adjustment of lower top cord frame members 22 with respect to lower bottom cord frame member 20, and when selected ones of adjusting holes 26 are in alignment, adjusting pins 27 can be placed in registration with adjusting holes 26 to securely position building press 1 into a desired pitch position. Adjustment of lower top cord frame members 22 with respect to lower bottom cord frame member 20 is made possible by top cord hammer swivel 31 joining upper top cord frame members 21. Accordingly, upper top cord frame members 21 and lower top cord frame members 22 can be pivoted upward on top cord hammer swivel 31 to permit removal of the finished trusses from the building press.

It will be appreciated by those skilled in the art that while the building press of this invention is illustrated in the drawings as a device for producing wall sections and truss members, these press configurations are only representative of many such configurations which can be designed using the basic frame, hammer and pressurized hose or hydraulic combination as disclosed herein. Accordingly, various building components of substantially any size and shape can be constructed by utilizing a building press of appropriate configuration according to the teachings of this invention. As an example, floor trusses and girder trusses where the top cord and bottom cords are parallel may be manufactured with a wide I beam 20 without top cord pressure or use of I beams 24. Additional hoses may be employed parallel with each other or more air, steam or hydraulic cylinders may be placed between I beam 22 and hammer 23 and 24, as desired.

It will also be appreciated by those skilled in the art that as noted above, means other than pressured hoses can be used to move the hammers of this invention in a desired direction to join the building components selectively located in the building press. For example, air, steam or hydraulic cylinders or ram means may be used according to the knowledge of those skilled in the art to effect the desired hammer movement. Other techniques may also be utilized as desired according to the teachings of this invention.

I claim:

1. A building press for joining building components comprising:

(a) a frame adapted to receive building components in a selected configuration;

(b) at least one hammer disposed in movable cooperation with said frame;

(c) a plurality of magnets magnetically carried by said hammer for selectively positioning fasteners on said hammer; and (d) pressure means in cooperation with said frame and said hammer to effect movement of said hammer with respect to said frame to force said fasteners into said building components and join said building components in said selected configuration with a single movement of said hammer.

2. The building press of claim 1 further including at least one filler disposed between said frame and said pressure means.

3. The building press of claim 1 wherein said pressure means is at least one hose and further comprising:

(a) at least one filler disposed between said frame and said at least one hose; and (b) at least one hose clamp, fluid release valve, and fluid inlet valve in cooperation with said at least one hose for controlling the fluid pressuring of said at least one hose.

4. A building press formed in the configuration of a roof truss to construct at least one roof truss for each operation of said press comprising an upper and a lower bottom cord frame member and upper and lower top cord frame members; a bottom cord hammer positioned in movable cooperation with said lower bottom cord frame member; a pair of top cord hammers positioned in movable cooperation with said lower top cord frame members; and pressure means in cooperation with said bottom cord hammer and said pair of top cord hammers to effect movement of said hammers and drive fasteners into said roof truss.

5. The building press of claim 4 wherein:

(a) said pressure means is a hose and said fluid is water;

(b) said building press is formed to construct a plurality of roof trusses for each pressuring of said hose; and (c) said upper top cord frame members and said lower top cord frame members are hinged to each other and are removably attached to said upper and said lower bottom cord frame member.

6. The building press of claim 5 further including at least one filler in cooperation with said lower bottom cord frame member to facilitate operation of said bottom cord hammers and said top cord hammers in essentially the same plane.

7. The building press of claim 4 further comprising removable braces for blocking said building components in secure position while said building components are stacked in said building press and wherein said upper and lower top cord frame members are adjustable with respect to said upper and said lower bottom cord frame member, and said upper top cord frame members and said lower top cord frame members are hinged, respectively, to permit adjustment of said building press and construction of truss members having a selected pitch.

* * * * *